US005461730A

United States Patent [19]

Carrington

[11] Patent Number: 5,461,730

[45] Date of Patent: Oct. 31, 1995

[54] PROTECTIVE HAT

[75] Inventor: Janice D. Carrington, Worcester, Pa.

[73] Assignee: Plum Enterprises, Inc., Worcester, Pa.

[21] Appl. No.: 103,488

[22] Filed: Aug. 6, 1993

[51] Int. Cl.[6] ..... A42B 3/00

[52] U.S. Cl. ..... 2/411; 2/205

[58] Field of Search ..... 2/410, 411, 414, 2/425, 417, 418, 205, 209.5, 209.7, 182.8, 181.6, 182.3, 183

[56] References Cited

U.S. PATENT DOCUMENTS

| | | | |
|---|---|---|---|
| D. 167,789 | 4/1952 | Adams | 2/205 |
| 223,177 | 12/1879 | Simis | 2/181.6 |
| 418,282 | 12/1889 | Fechter | 2/182.8 |
| 1,080,690 | 12/1913 | Hipkiss . | |
| 1,093,162 | 4/1914 | Yokoseck | 2/182.3 |
| 1,375,845 | 4/1921 | Horan . | |
| 1,508,702 | 9/1924 | Lark | 2/204 |
| 2,015,004 | 9/1935 | Duerr | 2/183 |
| 2,136,473 | 11/1938 | Sloan et al. . | |
| 2,140,716 | 12/1938 | Pryale | 2/414 |
| 2,296,335 | 9/1942 | Brady . | |
| 2,421,633 | 6/1947 | Lyon | 2/182.3 |
| 2,451,483 | 10/1948 | Goldsmith . | |
| 2,685,091 | 8/1954 | Thill | 2/204 |
| 2,717,384 | 9/1955 | Frothingham | 2/414 |
| 2,983,925 | 5/1961 | Gettinger | 2/204 |
| 3,171,133 | 3/1965 | Steffen | 2/414 |
| 3,276,039 | 10/1966 | Lish | 2/201 |
| 3,295,511 | 1/1967 | Crouzet | 126/208 |
| 3,315,273 | 4/1967 | Bullard | 2/418 |
| 3,366,971 | 2/1968 | Scherz | 2/200 |
| 3,440,660 | 4/1968 | Krinke | 2/410 |
| 3,551,911 | 1/1971 | Holden | 2/411 |
| 3,555,561 | 1/1971 | Neis . | |
| 3,725,956 | 4/1973 | Reisen | 2/205 |
| 4,279,097 | 7/1981 | Walker | 2/200 |
| 4,581,773 | 4/1986 | Cunnane | 2/204 |
| 4,982,451 | 1/1991 | Graham | 2/411 |
| 5,271,103 | 12/1993 | Darnell | 2/411 |

FOREIGN PATENT DOCUMENTS

| | | | |
|---|---|---|---|
| 646754 | 11/1928 | France | 2/410 |
| 517652 | 2/1940 | United Kingdom | 2/183 |

*Primary Examiner*—Jeanette E. Chapman
*Assistant Examiner*—Michael A. Neas
*Attorney, Agent, or Firm*—Robert C. Podwil

[57] ABSTRACT

A protective hat for children and adults comprises a head-enveloping member constructed of a core of impact absorbent foam, encapsulated within a shell of textile fabric material, the textile fabric material providing the inner and outer surfaces of the hat. The core is so constructed as to provide for conformity to the shape of head of the wearer, and to allow for ventilation. The bulk and density of the foam core is such that in sizes for children, the hat provides significant buoyancy.

8 Claims, 2 Drawing Sheets

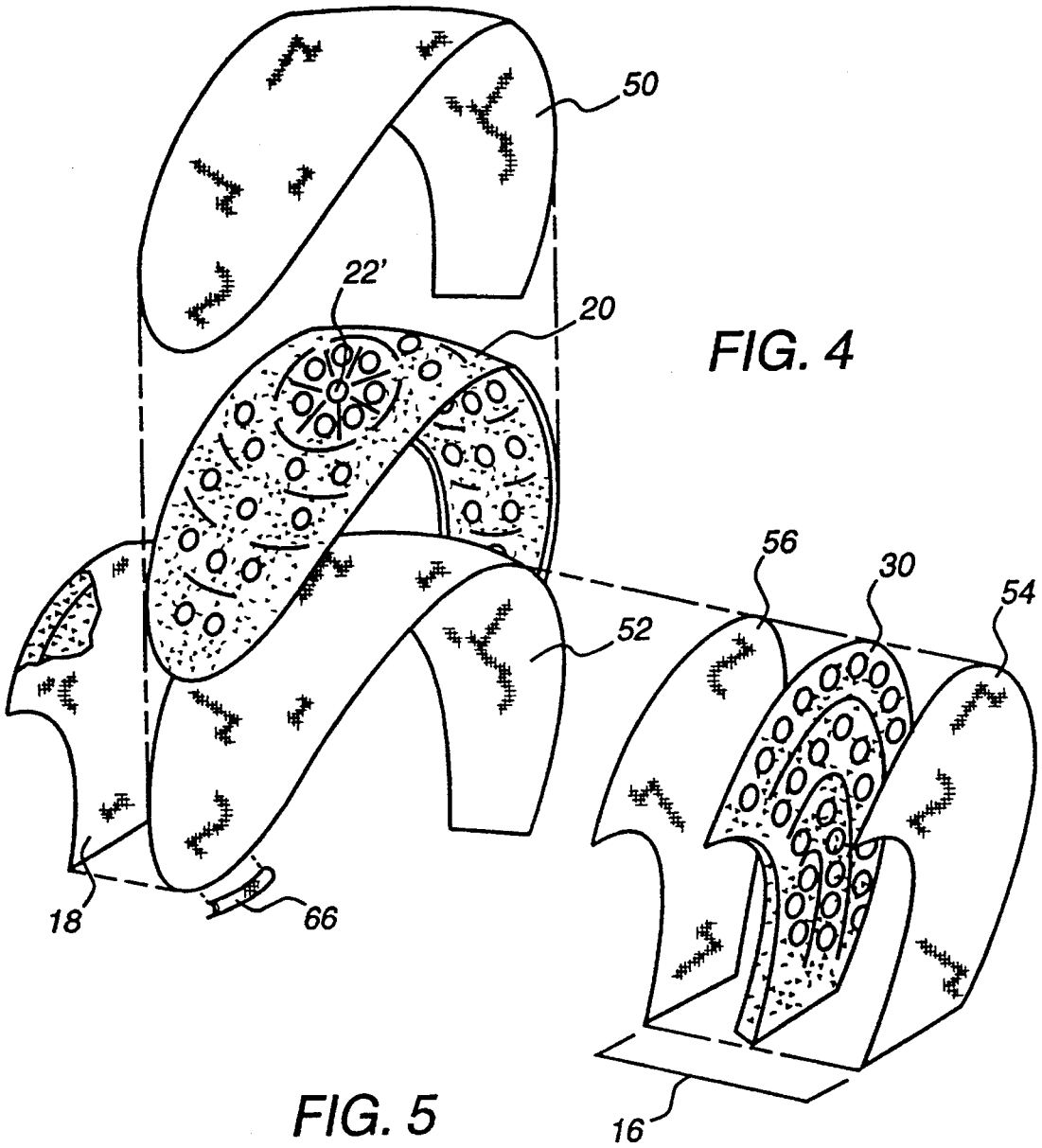
FIG. 4
FIG. 5
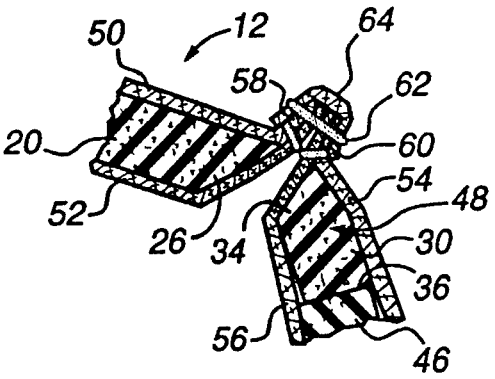

PROTECTIVE HAT

BACKGROUND OF THE INVENTION

This invention relates to protective headwear, and more specifically, to protective hats suitable for use by children, adolescents and adults.

Numerous kinds of protective headwear have heretofore been proposed. Such headwear, for example, the protective helmet shown in U.S. Pat. No. 3,171,133, issued Mar. 2, 1965, to Steffen, is often quite unconventional in appearance and objectionable for that reason alone.

Attempts have been made to provide combined dress and protective headwear, usually for children. For example, in U.S. Pat. No. 2,717,384, issued Sep. 13, 1995 to I. Frothingham, a combined dress and protective hat was proposed which included a circular cap, constructed over a cruciform framework of protective elements. This device, too, differs greatly in appearance from conventional headgear, and reveals itself at once to be a specially constructed protective device.

In my U.S. Pat. No. 4,581,773, issued Apr. 15, 1986, I described two embodiments of a protective hat, specifically intended for infants and toddlers, which provides a conventional and unobjectional appearance, while also comfortably providing a protective function. The hat of that patent is constructed using components made up of cores of resilient shock absorbent foam material, encapsulated in fabric shells.

In attempting to apply the principles of my U.S. Pat. No. 4,581,773 to protective hats for larger sizes, such as for children four years of age and older, adolescents and adults, it has been found that simply enlarging the hat and providing thicker foam is not a practical solution. On the contrary, it has been found that use in the patented construction of core elements in excess of about ⅜ inch in the thickness produces a hat difficult to shape to the head of a wearer, uncomfortable to wear due to poor ventilation, and difficult to fabricate. It is an object, therefore, of this invention, to provide an easily manufactured protective hat, the novel features of which make it suitable for use by older children, adolescents and adults.

Summary of the Invention

The foregoing and other objects of this invention are realized, in a presently preferred form of the invention, by providing a protective hat which comprises a head-receiving member which overlies and protects at least the sides, top and rear of the head of a wearer, the head-receiving member comprising a core of resilient shock absorbent polymeric foam material and a shell of textile fabric, so constructed as to have the appearance of a conventional hat. The core is so configured and constructed that it readily conforms in use to the head of the wearer, and provides for adequate ventilation, all while also providing enhanced impact protection.

In one presently contemplated and preferred form of the invention, the head-receiving member is fabricated from three subassemblies, one an arcuate member which partly encircles the head of a wearer, disposed in the direction of the medial plane of the head, and side pieces which enclose the sides of the head, preferably covering the temple, ears and a portion of the lower jaw of the wearer. Edge portions of the side pieces are complemental with and coupled to respective edge portions of the arcuate member. Together, the arcuate member and the side members form a concavity adapted to receive the head of a wearer. Other configurations are possible within the purview of the invention.

In accordance with the invention, the arcuate member and the side pieces have an inner core, comprising a layer of impact absorbent foam material, preferably of the closed-cell type, fully enclosed within a shell of textile fabric to give the article a conventional appearance and "feel". The thickness of the cores is such that the hat has considerable and noticeable "bulk", and in smaller sizes, the hat has significant buoyancy in water relative to the weight of the user.

There is seen in the drawings a form of the invention which is presently preferred (and which represents the best mode contemplated for carrying the invention into effect), but it should be understood that the invention is not limited to the precise arrangements and instrumentalities shown.

BRIEF DESCRIPTION OF THE DRAWINGS

FIG. 4 is an exploded view, showing details of the construction of a hat in accordance with the invention;

FIG. 5 is a partial cross-sectional view, taken along the line 5—5 in FIG. 1, and showing a construction detail of a hat in accordance with the invention.

DETAILED DESCRIPTION OF THE INVENTION

Figure 1:
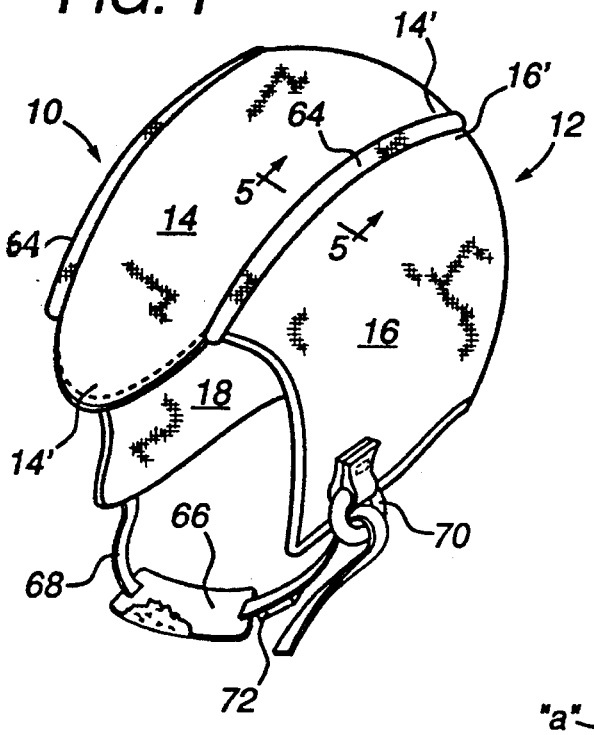
FIG. 1 is a perspective view of a protective hat in accordance with the present invention.

Referring now to the drawings in detail, wherein like reference numerals indicate like elements, there is seen in FIG. 1 a protective hat designated generally by the reference numeral 10.

The protective hat 10 comprises a head enveloping member, designated generally by the reference numeral 12, which may also be referred to as a "crown". The head enveloping member 12 is adapted to overlie and protect at least the sides and top of the head of a wearer.

The head-enveloping member 12 includes an arcuate member 14, which covers and protects the head of a wearer from a forwardly projecting tip 14' disposed just above the eyebrows to the nape of the neck. The arcuate member 14 extends, in general, in the direction of the medial plane of the head. The head enveloping member 12 also includes side pieces 16 and 18, joined to the arcuate member 14 in a manner to be described below.

The arcuate member 14 and side pieces 16, 18 together form a concavity, closed on three sides and at the top, which may be placed over the head of the wearer. The side pieces 16 and 18 are so arranged with respect to the arcuate member 14 that edge portions of the side pieces 16 and 18, such as the edge portion 16' in FIG. 1, are complemental with and coupled to respective edge portions of the arcuate member 14 (such as the edge portion 14' in FIG. 1).

The arcuate member 14 and side pieces 16 and 18 of the head enveloping member 12 preferably include a resilient shock absorbent core of plastic polymeric material, enclosed in a shell preferably of textile fabric material, as is perhaps best seen in FIG. 4, less desirably, the shell may be of other materials, such as plastic polymeric sheet.

Figure 3:
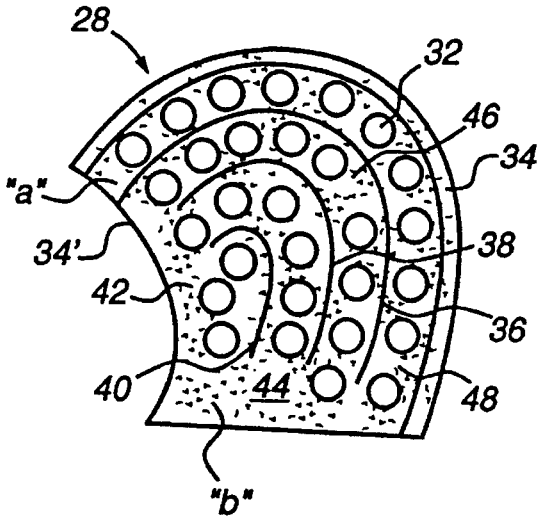
FIG. 3 is a plan view of another core element used in the present invention.
Figure 2:
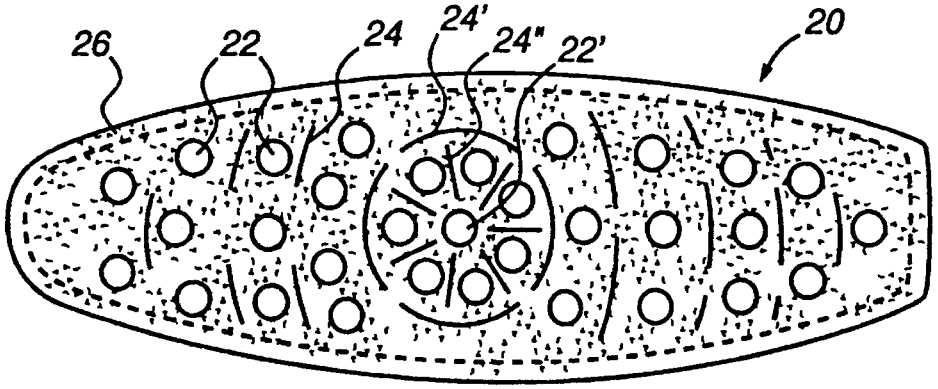
FIG. 2 is a plan view of a core element used in the present invention.

FIG. 2 illustrates a presently preferred form a core for the head-enveloping member of crown 12. The core 20 comprises an initially flat sheet of shock absorbent and thermally insulating material, which may be cut or die stamped to shape from a flat sheet of raw material. The core 20 is perforated, as by holes 22, to enhance the vapor permeability of the finished hat 10, and is also be perforated, as by the illustrated slits 24. The edges 26 of the core 20 are bevelled (as best seen in FIG. 4), for a purpose described below, and the shape of the core 20 is such as to facilitate assembly of the head-enveloping member 12 and side pieces 16 and 18. The side pieces 16 and 18 have cores 28 and 30, which may be cut or die stamped from a sheet of suitable material, preferably the same kind of material as the core 20. Referring now to FIG. 3, like the core 20, the cores 28 and 30 (of which the core 28 is seen in FIG. 3) may be provided with holes 32, which serve to provide ventilation as do the above-mentioned holes 22 of the core 20. The edges of the cores 28 and 30 may be bevelled, as at 34, complementally with the bevelled edges 26 of the core 20. The cores 28 and 30 are also provided with slits 36, 38 and 40, like the above-mentioned slits 24, the purposes of which will be explained below.

Referring again to FIG. 2, it will be seen that in the preferred embodiment shown the holes 22 in the core 20 are preferably arranged in what may be described as roughly in arcs about what may be considered a central hole 22'. The slits 24 are arcuate and are for the most part cut widthwise of the member 14 and roughly parallel to the arcs of the holes 22 to which they are closest. The slits around the central hole 22' comprise arcuate segments 24' generally surrounding the central hole 22', and radial segments 24" extending outwardly from the central hole 22'. The slits 24, and to a lesser extent, the holes, facilitate conformity of the initially flat core 20 to the compound curvature of the head of a wearer. They also enhance ventilation.

Referring now to FIG. 3, it will be understood that the core 28 depicted is the core associated with the side piece 18. The core 30 associated with the side piece 16 is similarly configured, but beveled on the opposite face (see FIG. 4).

The cores 28 and 30, and hence the side pieces 16 and 18 with which they are associated, are shaped to include a zone "a", projecting forwardly when the hat 10 is operatively disposed so that it overlies and fully protects the temple of the wearer. The cores 28 and 30 also include a zone "b" which overlies and protects a portion of the lower jaw of the wearer when the hat 10 is operatively disposed. The lower edge of the core 28 is preferably generally horizontally oriented, to maximize protection of the jaw. It should be apparent that the slits 36, 38 and 40 are of a curved contour, spaced from each other, and cut in the illustrated embodiment so that the slit 36 is roughly parallel to the edge 34. The slits 36, 38 and 40 may be described for convenience as "nested" curves, generally parallel to one-another in the sense that they do not intersect or sharply converge their respective lengths. The areas bounded by and within the curves defined by the respective slits 36, 38 and 40 may, when the hat 10 is fitted to the head of a wearer, be offset to permit the cores 28 and 30 (and subsequently the side pieces 16 and 18) to take on compound curves, enabling the side pieces to conform to the head of the wearer. The shape and orientation of the larger slits 38 and 40 is preferably such that at least one of the slits 38 and 40 in part surrounds the ear of user of the hat 10. The slits 36, 38 and 40 and the holes 32 allow for better hearing through the hat 10 and for the presence of hearing aids. The slit 40, farthest from the edge 34, takes the form of relatively small radius, and forms a tab-like zone or region 42. The area between the slits 40 and 38 forms a zone or region 44, and the area between the slits 38 and slit 36 forms a zone or region 46. The area between the slit 36 and the edge 34 of the side piece 16 may be said to form a zone or region 48.

In the illustrated form of the side piece 16, the holes 32 in the zone or region 48 form an arc generally parallel to the contour of the edge 34. The holes 32 in the zone or region 46 likewise form an arc generally parallel to the contour of the edge 34. The holes in the zone or region 44 follow the contour of that zone or region, and the holes in the zone or region 42 include holes which, together with holes disposed in the other regions, form an arc generally parallel to the front edge 34' of the side piece 16. Another hole is disposed generally at what may be considered a focal point of the small-radius arc defined by the slit 40. Other arrangements of slits and holes may of course be used.

Referring now to FIG. 4, it will be seen that the core 20 is enclosed by fabric shell pieces 50 and 52, which are eventually stitched together around their peripheries and outside the periphery of the core 20. The cores 28 and 30 are preferably enclosed in a similar manner. Thus, referring again to FIG. 4, an outer shell piece 54 and an inner shell piece 56 are associated with the core 28. Like the above-described shell pieces 50 and 52, the shapes of the respective shell pieces 54 and 56 approximate the shape of the core with which they are associated, in this instance the core 30. The outer shell piece 54 and inner shell piece 56 are stitched together around the periphery and outside the periphery of the core 30.

The material from which the shell pieces 50, 52, 54 and 56 are made may be any suitable fabric. In one presently preferred form of the invention, the material used for the shell pieces is a broadcloth of 65% polyester and 35% cotton. Such a material provides a desirable degree of durability and soil resistance, as well as an acceptable feel and conventional appearance. It has been found desirable to cut the inner shell pieces on the bias, whereas the outer shell pieces are advantageously straight of grain. Water-resistant nylon and other fabrics or materials may be used depending upon the desired application.

Referring now to FIG. 4, the shell which encloses the cores 20 and 30 will be described in greater detail. An outer shall piece 50 provides the outer surface of the top of the head enveloping member 12, and an inner shell piece 52, provides an inner lining of the top portion of the head enveloping member 12. The outer and inner shell pieces 50 and 52 are cut or stamped to a shape somewhat similar to the shape of the core 20, but somewhat larger, and they are stitched to each other around their peripheries outside the peripheral edge of the core 20. When such stitching is completed, the outer and inner shell pieces 50 and 52 fully enclose and encapsulate the core 20 so that the outer surfaces of the protective hat 10 have a conventional appearance and texture imparted by the material of the shell pieces 50 and 52.

As in the case of the core 20, the core 28 and 30 are enclosed and encapsulated in a suitable shell of fabric.

FIG. 5 shows a construction detail of a protective hat in accordance with the invention. It illustrates the assembled relationship among the cores 20 and 30 and the fabric shell pieces 50 and 52 and 54 and 56, respectively. It also illustrates the manner in which the head-enveloping member 12 and side pieces 16 and 18 may be assembled and the manner in which the cores can conform to the head of the wearer. Referring to FIG. 5, it will be seen that the respective outer shell piece 50 and inner shell piece 52, and outer shell piece 54 and inner shell piece 52, when sewn together around the peripheries of their respective cores 20 and 30, provide small areas of selvage 58, 60 which facilitate their being stitched together as at 62, to construct the head-enveloping member 12. The bevelled edges 26 and 34 of the cores 20 and 30 provide in effect, a "mitre", allowing for an angled corner. A variety of stitching and finishing techniques may occur to those skilled in the art, but it is presently preferred that the selvage of the shell pieces 50 and 52 and the selvage of the outer shell pieces 54 and 56 be joined by a line of stitching 62, and that binding material 64 be used to "pipe" or finish the edge. The binding material may be cotton or cotton-poly interlock knit or other suitable material.

The cores 20 and 28 are ideally made from dimensionally stable, chemically inert, highly impact resistant material. One suitable material, which is presently used is sold by Uniroyal, Inc. under the trademark "Ensolite", type "AA." It comprises a closed-cell foam of specially modified PVC with nitrile rubber. The material is a cross-linked polymer capable of withstanding repeated impact/recovery cycles, and has a density of between about 4.0 and 6.0 lbs./cu. ft., a thermal conductivity of 0.26, and a 25% compression resistance of 5.0 to 7.0 psi at 70° F. Other equivalent foams can be used. In presently preferred forms of the invention, the cores 20 and 28 have thicknesses of about ⅜ inch to 1 inch, as is explained below.

It has been found that in constructions in accordance with the invention, for sizes appropriate for children age 4 through 7, the thickness of the foam is preferably in the range of ⅜ to ½ inch, and the holes in the cores approximately ⅜ inch in diameter. For children ages 7 through 12 years, the thickness of the foam is preferably from ½ to ¾ inch, and the holes in the cores approximately ½ inch diameter. For adult sizes, the thickness of the foam is preferably in the range of ⅝ to 1 inch, and the holes in the cores approximately 9/16 inch in diameter.

A suitable chin strap 68, 0-ring 70 or other means of securement may be provided to secure the hat 10 to the head of a wearer. For example, referring to FIG. 1, the illustrated chin strap 68 may be passed through a light weight "unbreakable" plastic O-ring 70, and secured to itself by self-adhering fasteners 72 of the "Velcro" type. Other arrangements will occur to those skilled in the art. The chin strap 68 may be of cotton or polycotton interlock knit fabric or other suitable material. As may be seen in FIG. 1, a chin guard 66 may be associated with the chin strap 68, for added chin protection and wearer comfort. The chin guard 66 (shown partly broken away in FIG. 1) may be made of foam like that of the cores 20, 28 and 30, of suitable thickness appropriate to the intended user, and covered with a shell of fabric to match the fabric of the above-described shell pieces. Other arrangements may also be used.

The present invention has been found to be useful in numerous applications for children. Among these are: post-surgery protection, and protection from head trauma in cases of physical or emotional disability. The invention is also of use in preventing or moderating head injuries in play activities such as sledding and skiing, and it has been found that the flotation property of the closed end foams used makes the invention useful as an aid to swimming instruction for children. The thermal insulating properties of the foam are useful for sledding and skiing. For older children, the conventional look of the hat has been found to be more appealing to image-conscious adolescents than traditional protective helmets, and the present protective hat is believed to be more comfortable to wear than traditional helmets. For adults, the present hat is a comfortable, lightweight, safe alternative to unsightly protective helmets in current use in a number of applications related to problems associated with aging.

The present invention may be embodied in other specific forms without departing from its spirit or essential attributes. Accordingly, reference should be made to the appended claims rather than the foregoing specification and accompanying drawings for an indication of the scope of the invention.

I claim:

1. A protective hat having shock absorptive and insulating properties, comprising a head-receiving member adapted to overlie and protect at least the sides, top and rear of the head of a wearer, said head-receiving member comprising a core of resilient shock absorbent polymeric foam material and a shell of textile fabric material, said shell being so constructed and arranged as to fully enclose and encapsulate said core so that said hat has a conventional appearance and surface texture, said head-receiving member comprising an arcuate member adapted to partly encircle the head of a wearer, and at least one closure member, said closure member having edge portions thereof complemental with and fixedly coupled to respective edge portions of said arcuate member so that said arcuate and said closure member define a concavity adapted to receive the head of a wearer, said core comprising closed cell foam material having a thickness of about ⅜ to about 1 inch, said core having thereon a plurality of spaced holes therethrough distributed over the surface of said core to facilitate ventilation of said concavity, and said core having a plurality of slits therethrough, said slits being disposed between said holes to facilitate conformity of said core to the shape of the head of a user and to further facilitate ventilation of said concavity, at least some of said slits being arranged as nested generally parallel curves and at least some of said holes being disposed in arcuate rows disposed in the direction of said curves.

2. Apparatus in accordance with claim 1, wherein said core comprises closed cell foam material consisting of a cross-linked polymer of modified PVC and nitrile rubber.

3. Apparatus in accordance with claim 1, wherein said closure member comprises a side piece having a core of resilient shock absorbent foam material and a shell of textile fabric material, said shell being so constructed and arranged as to fully enclose and encapsulate said core of said side piece.

4. Apparatus in accordance with claim 3, wherein some of said holes on said core of said side piece are so disposed as to overly the ear of a wearer, at least one of said slits being so shaped as to in part surround the ear of a wearer to facilitate conformity of said side piece to the shape of the side of the head of a user.

5. Apparatus in accordance with claim 1, wherein said core of said arcuate member has a central opening, some of said slits being disposed around said central opening.

6. Apparatus in accordance with claim 5, wherein at least some of said slits extend radially from said central opening.

7. A protective hat having shock absorptive and insulating properties, comprising a head-receiving member adapted to overlie and protect at least the sides, top and rear of the head of a wearer, said head-receiving member comprising a core of resilient shock absorbent polymeric foam material and a shell of textile fabric material, said shell being so constructed and arranged as to fully enclose and encapsulate said core so that said hat has a conventional appearance and surface texture, said head-receiving member comprising an arcuate member adapted to partly encircle the head of a wearer, and at least one closure member, said closure member having edge portions thereof complemental with and fixedly coupled to respective edge portions of said arcuate member so that said arcuate and said closure member define a concavity adapted to receive the head of a wearer, said core comprising closed cell foam material, said core having thereon a plurality of spaced holes therethrough to facilitate ventilation of said concavity, said holes being distributed over the surface of said core with at least some of said holes arranged in arcuate rows, and said core having a plurality of arcuate slits therethrough, said slits being disposed between said rows of holes to facilitate conformity of said core to the shape of the head of a user and to further facilitate ventilation of said concavity.

8. Apparatus in accordance with claim 7, wherein said arcuate member covers the head of a wearer from the forehead to the nape of the neck.

* * * * *

UNITED STATES PATENT AND TRADEMARK OFFICE

CERTIFICATE OF CORRECTION

PATENT NO. : 5,461,730

DATED : Oct. 31, 1995

INVENTOR(S) : Janice Carrington

It is certified that error appears in the above-indentified patent and that said Letters Patent is hereby corrected as shown below:

On the Title page, item [75] inventor;

Delete middle initial "D.".

Signed and Sealed this

Nineteenth Day of March, 1996

*Attest:*

Bruce Lehman

BRUCE LEHMAN

*Attesting Officer*

*Commissioner of Patents and Trademarks*